US006988647B2

(12) United States Patent
Perry

(10) Patent No.: US 6,988,647 B2
(45) **Date of Patent: *Jan. 24, 2006**

(54) DEVICE FOR SUSPENDING A RECORDER AND METHOD FOR USING THE SAME

(75) Inventor: Andrew M. Perry, Salem, OR (US)

(73) Assignee: Peripole-Bergerault, Inc., Salem, OR (US)

( * ) Notice: Subject to any disclaimer, the term of this patent is extended or adjusted under 35 U.S.C. 154(b) by 188 days.

This patent is subject to a terminal disclaimer.

(21) Appl. No.: 10/661,307

(22) Filed: Sep. 12, 2003

(65) Prior Publication Data

US 2004/0050892 A1 Mar. 18, 2004

Related U.S. Application Data

(63) Continuation of application No. 08/689,721, filed on Aug. 12, 1996, now Pat. No. 6,651,856.

(51) Int. Cl.
*G10G 5/00* (2006.01)

(52) U.S. Cl. ..... 224/604; 224/251; 224/910

(58) Field of Classification Search ..... 84/380 R, 84/470 R, 387 A, 453, 385 A, 380 C; 224/148.4–148.7, 224/148.1, 258, 605, 250, 910, 251, 604
See application file for complete search history.

(56) References Cited

U.S. PATENT DOCUMENTS

| | | | | |
|---|---|---|---|---|
| 3,186,611 | A | 6/1965 | Sonderman | |
| 3,363,497 | A | 1/1968 | Thompson | |
| 4,355,804 | A | 10/1982 | Bingham | |
| 4,674,298 | A | 6/1987 | Wimmershoff-Caplan | 224/251 |
| 4,841,829 | A | 6/1989 | Lehmann | 224/910 |
| 4,884,730 | A | 12/1989 | Carpenter | |
| 5,167,356 | A | 12/1992 | Williams | 224/251 |
| 5,203,481 | A | 4/1993 | Dobbins et al. | |
| 5,398,855 | A | 3/1995 | Schaiewitz | |
| 6,384,307 | B1 | 5/2002 | Sueta et al. | 84/385 A |
| 6,648,197 | B2 * | 11/2003 | Perry | 224/604 |

* cited by examiner

*Primary Examiner*—Renee Luebke
(74) *Attorney, Agent, or Firm*—Marger Johnson & McCollom

(57) ABSTRACT

An apparatus for the carrying of a recorder includes a ring sized to fit around the shaft of the recorder in a position that consistently permits playability of the recorder and a strap attached to the ring having sufficient length so as to fit around the neck of the person playing the recorder and allowing the recorder to hang in a position of easy access.

8 Claims, 2 Drawing Sheets

Fig. 1
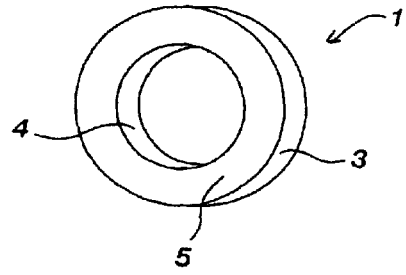
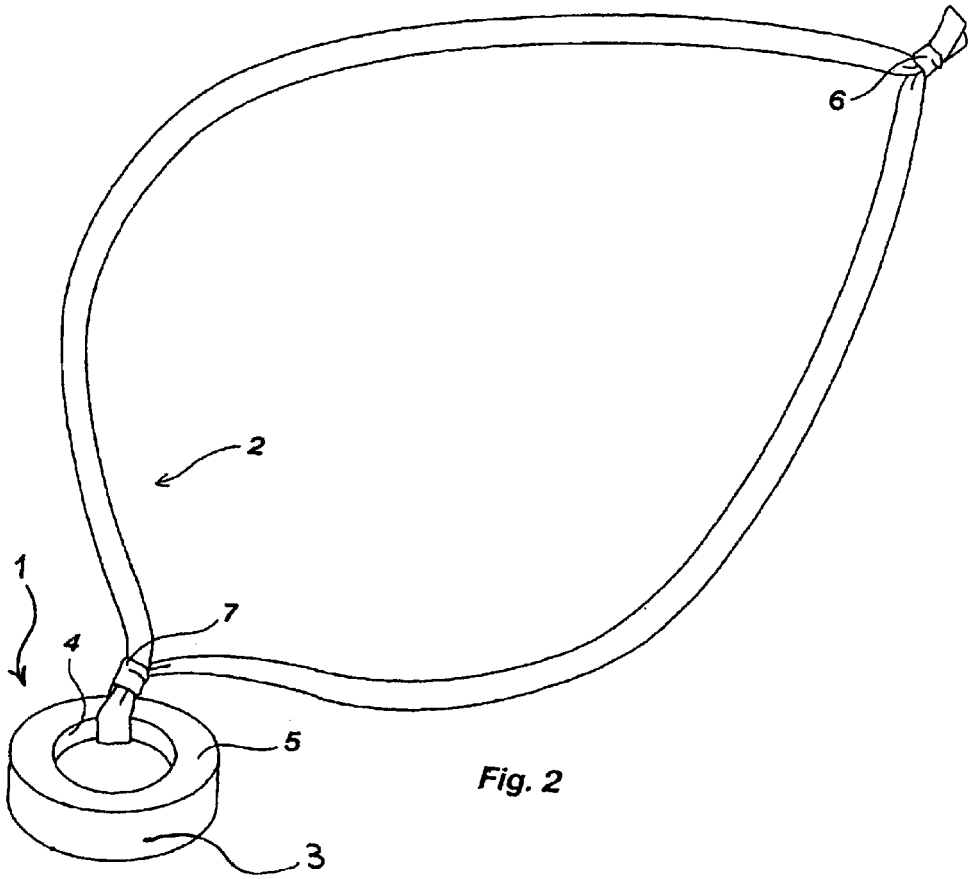
Fig. 2

DEVICE FOR SUSPENDING A RECORDER AND METHOD FOR USING THE SAME

CROSS REFERENCE

This application is a continuation of and claims priority from U.S. patent application Ser. No. 08/689,721, filed on Aug. 12, 1996, now U.S. Pat. No. 6,651,856, issued Nov. 25, 2003, the contents of which are incorporated herein by reference, in their entirety. This application also related to U.S. patent application Ser. No. 10/150,411, filed on May 17, 2002, now U.S. Pat. No. 6,648,197, issued Nov. 18, 2003, the contents of which are also incorporated herein by reference in their entirety.

BACKGROUND OF THE INVENTION

1. Field of the Invention

This invention pertains to the general field of a neck strap arrangement for carrying a musical instrument. In particular, it provides a new and improved method of carrying a woodwind musical instrument known as a recorder.

2. Description of Prior Art

The recorder is an instrument that is of such size that it can be carried easily. This instrument is most often used by children in early grade school for instruction in music. Most often the child will purchase a recorder. The child will then carry the recorder to class and carry it in the hand during class. If the child needs to use the hands for another purpose, the recorder is laid down and subject to loss or confusion when play is to be continued. Also, like anything a child is forced to carry in their hands, the object can be inappropriately used as a toy, weapon, or whatever fits the occasion.

Prior art is limited to some resourceful teachers that have simply tied a string around the recorder with some sort of loop that is placed around the child's neck to suspend the recorder. Because the knots may slip, come untied or can not be readily untied, this method has not gained wide support. In addition, after the teacher has tied all the knots required by the students, the teacher has little time left for instruction. Thus, at the present time, there is no suitable means for the hand free carrying of the recorder.

SUMMARY OF THE INVENTION

It is therefore an objective of this invention to provide a device for conveniently carrying a recorder securely affixed to a strap that is worn about the neck.

Another objective of the invention is the realization of the above mentioned objective with simple, reliable and inexpensive hardware.

In accordance with these and other objectives, the method and apparatus of this invention consist of a ring and an attached strap. The ring is made of resilient material and is of sufficient inside diameter so as to fit, after the strap has been secured to the ring, snugly around the shaft of the mouth piece of the recorder. The ring is secured on the recorder by pulling the recorder apart at its dividing point and then slipping the ring around the mouth piece section and sliding it up the shaft until it is securely lodged on the shaft. Because the diameter of the shaft, of the mouth piece section, increases from the separation point towards the other end, the ring will be secure on the recorder shaft approximately one inch from the dividing point. The two pieces of the recorder are then reconnected.

Various other purposes and advantages of the invention will become clear from its description in the specifications that follows, and from the novel features particularly pointed out in the appended claims. Therefore, to the accomplishment of the objectives described above, this invention consists of the feature hereinafter illustrated in the drawings, fully described in the detailed description of the preferred embodiment and particularly pointed out in the claims. However, such drawings and description disclose only some of the various ways in which the invention may be practiced.

BRIEF DESCRIPTION OF THE DRAWINGS

This invention together with its features and advantages can be better understood from the following description when read in conjunction with the drawings in which FIG. 1 is a perspective view of the ring of the device of the invention.

FIG. 2 is a perspective view of the device of the invention.

DETAILED DESCRIPTION OF INVENTION

Figure 3:
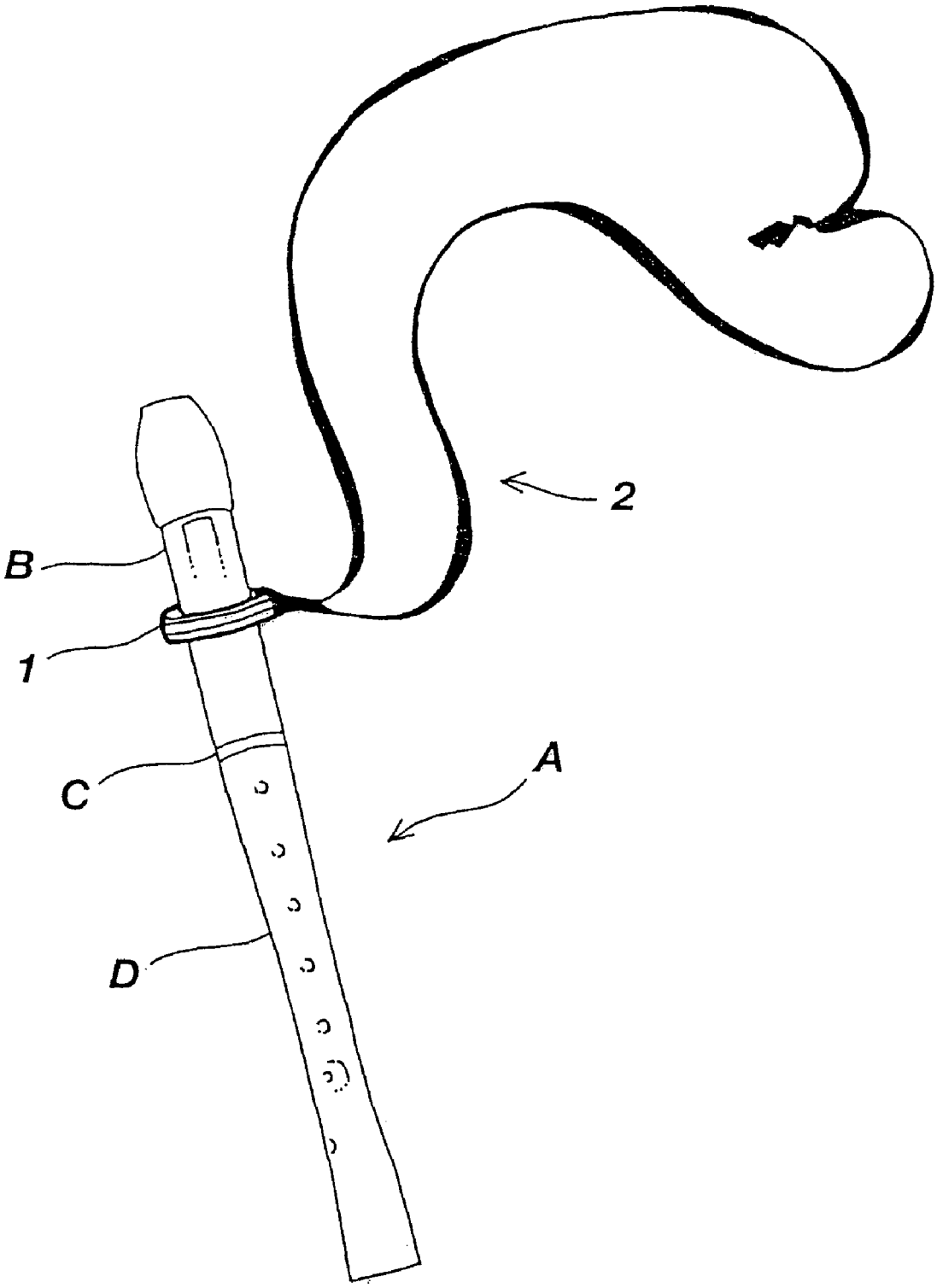
FIG. 3 is a perspective view of the device attached to a recorder.

The heart of this invention lies in the simple ring, which makes it possible to conveniently attach a strap to a recorder. Thus, the main objective of providing an easy method to carry a recorder is met.

Referring to the drawings, wherein the same reference numbers and symbols are used throughout to designate like parts, FIG. 1 illustrates the general configuration of the ring 1 before the strap 2 is attached and it is mounted on the recorder A.

The ring 1 has a surface 3 and 5 of such dimensions so as to provide strength enough to withstand the rigors and forces that would be anticipated when the device is in use by elementary age school children. As illustrated in FIG. 1, the precise geometry of the inner surface 4 of the ring is a circle with a diameter larger than the diameter of the recorder A at the point of the juncture C of the two pieces B and D of the recorder A. The diameter of the mouth piece B section of the recorder A increases from the separation point C to the air hole of the mouth piece B located just above the mid point of the mouth piece B.

The strap 2 is made of a material that is strong enough to hold the recorder or other desired object, yet be comfortable when placed around the neck. The knot 7 is tied in the middle of strap 2 after placing one end through the ring 1. Knot 6 is any knot that will neatly secure the ends of the strap 2.

The ring 1 is attached to the recorder A by pulling apart the two pieces B and D of the recorder A at the separation point C. The ring 1 is then slid onto the shaft of the mouth piece B of the recorder 1 at the end that attaches to the fingering piece D of the recorder A. The ring 1 will slip onto the mouth piece B and then lodge at a point approximately one inch up the shaft due to the slight taper of the shaft. After a suitable strap is attached to the appropriate size ring, the ring is attached to a recorder by slipping the ring onto the upper section of the recorder. The strap may be adjusted so that the recorder hangs comfortably from the neck of the person playing the recorder.

While the present invention has been shown and described herein in what is believed to be the most practical and preferred embodiment, it is recognized that departures can be made therefrom within the scope of the invention, which is therefore not to be limited to the details disclosed herein, but is to be accorded the full scope of the claims so as to embrace any and all equivalent apparatus and methods.

What is claimed is:

1. A combination, comprising:

a ring;

a separate strap attached to the ring; and a recorder, wherein the ring is disposed around a shaft of the recorder.

2. A combination according to claim 1, wherein the ring supports the recorder without impairing its playability.

3. A combination according to claim 1, wherein the strap is a neckstrap configured to support the recorder from a neck of a user in a position of ready accessibility.

4. A combination according to claim 1, wherein the ring lodges around the shaft of the recorder in a position that does not block any air holes of the recorder.

5. A combination according to claim 4, wherein the ring lodges at a point along the shaft of the recorder near the mouth piece end.

6. A combination comprising:

a ring;

a separate strap tied to the ring; and a recorder, wherein the ring is disposed around a shaft of the recorder.

7. A combination comprising:

a recorder comprising a shaft having a mouth piece section disposed at a first end of the recorder shaft, wherein a diameter of the shaft is enlarged along a portion of the mouth piece section of the shaft;

a ring disposed around the mouth piece section of the shaft; and a separate strap attached to the ring and configured to suspend the recorder from the neck of a user.

8. A combination according to claim 7, wherein the ring is disposed around the mouth piece section of the shaft by sliding the ring along the shaft until it lodges around the shaft in a position that does not block recorder air holes.

* * * * *